United States Patent [19]

Nelson

[11] Patent Number: 4,598,941

[45] Date of Patent: Jul. 8, 1986

[54] PILFERAGE DETERRENT DEVICE FOR LADING, CARRYING VEHICLES, SUCH AS BOXCARS AND THE LIKE

[76] Inventor: Stanford C. Nelson, 8 S. Merrill, Park Ridge, Ill. 60068

[21] Appl. No.: 520,179

[22] Filed: Aug. 4, 1983

Related U.S. Application Data

[63] Continuation-in-part of Ser. No. 298,592, Sep. 2, 1981, abandoned.

[51] Int. Cl.[4] ..... E05C 3/10

[52] U.S. Cl. ..... 292/134; 105/308 P; 292/336; 292/337; 292/346

[58] Field of Search ..... 292/238, 108, 130, 131, 292/134, 136, 230, 236, 336, 210, 132, 133, 135, 237, 231–235, 239, 337, 205, 104, 346, DIG. 46; 105/378, 308 P, 308 R

[56] References Cited

U.S. PATENT DOCUMENTS

| | | | |
|---|---|---|---|
| 657,742 | 9/1900 | Lewis | 292/108 |
| 882,296 | 3/1908 | Carroll | 292/130 |
| 891,667 | 6/1908 | Browning | 292/238 X |
| 1,177,495 | 3/1916 | Davis | 292/130 |
| 1,258,132 | 3/1918 | Martin et al. | 292/237 X |
| 1,319,187 | 10/1919 | Summers | 292/238 |
| 1,434,280 | 10/1922 | Bell | 292/136 X |
| 1,444,410 | 2/1923 | Witten | 292/238 X |
| 1,446,078 | 2/1923 | Willis | 292/238 |
| 1,489,965 | 4/1924 | Prentice | 292/108 X |
| 1,495,373 | 5/1924 | Witten | 292/210 X |
| 2,523,845 | 9/1950 | Roseburrough | 292/108 |
| 3,201,830 | 8/1965 | Senter et al. | 105/378 |

FOREIGN PATENT DOCUMENTS

| | | | |
|---|---|---|---|
| 84087 | 8/1954 | Norway | 292/136 |

*Primary Examiner*—Robert L. Wolfe
*Assistant Examiner*—Russell W. Illich
*Attorney, Agent, or Firm*—Hill, Van Santen, Steadman & Simpson

[57] ABSTRACT

Pilferage deterrent device for box car, container or trailer doors of the type in which the device is toward the top of the door out of reach of a person standing on the ground, and only accessible to release the latch from the top, by a person standing on a loading dock or elevated platform. The latch cooperates with a keeper and both the keeper and latch are enclosed so access cannot be had to the latch to release the latch by a pole or elongated tool.

A pivoted release member termed a trigger extends above a housing for the latch and is transversely pivoted to the housing and protected by the housing to prevent access to said release member from the ground. The release member has camming engagement with the latch and is operable by hand to cam the latch out of engagement with the keeper and accommodate opening of the door.

8 Claims, 8 Drawing Figures

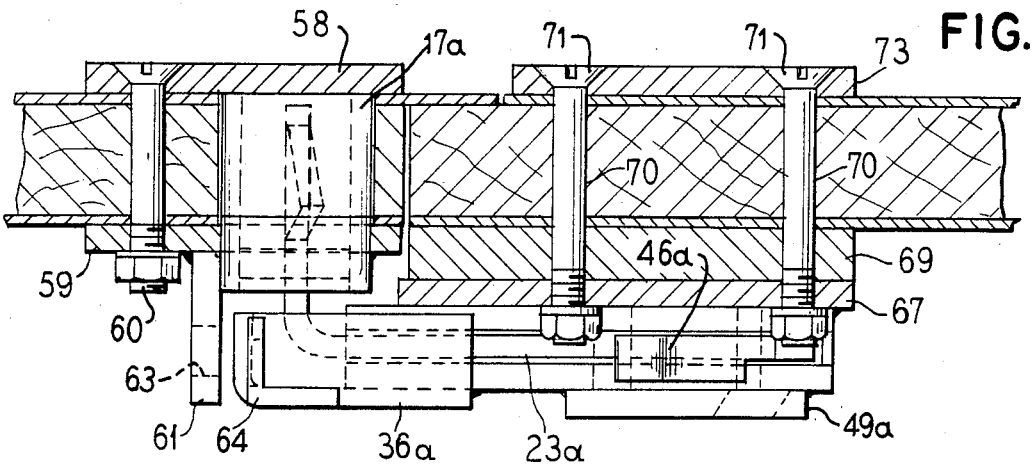
FIG. 5
FIG. 6
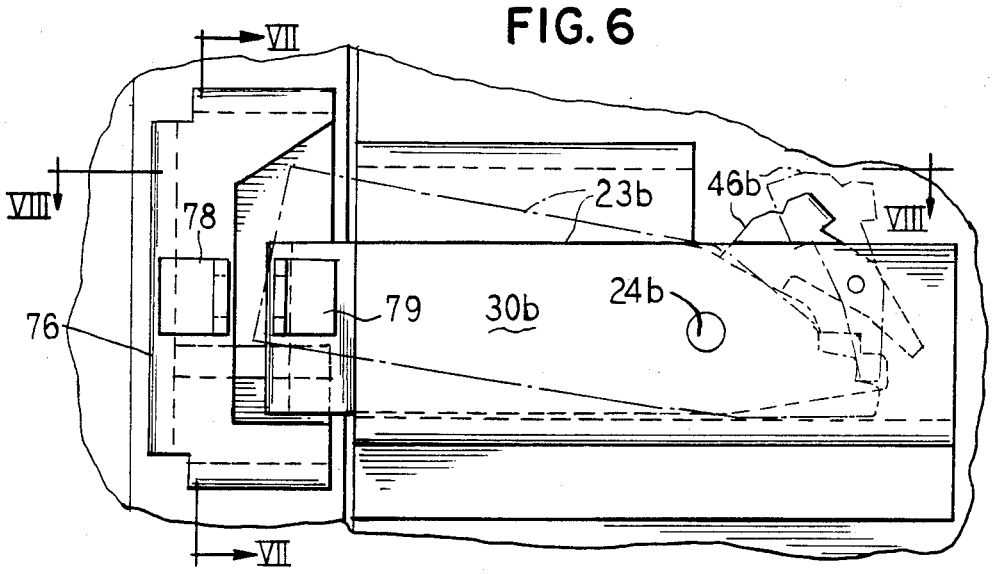
FIG. 7
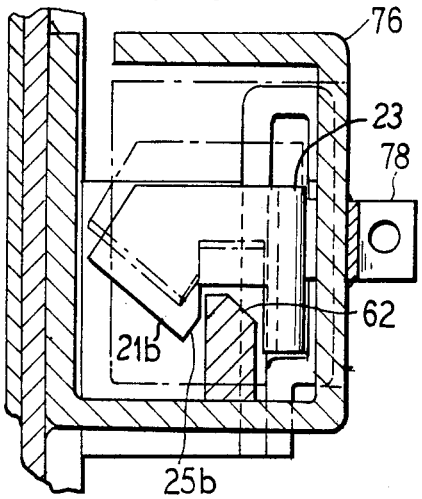
FIG. 8
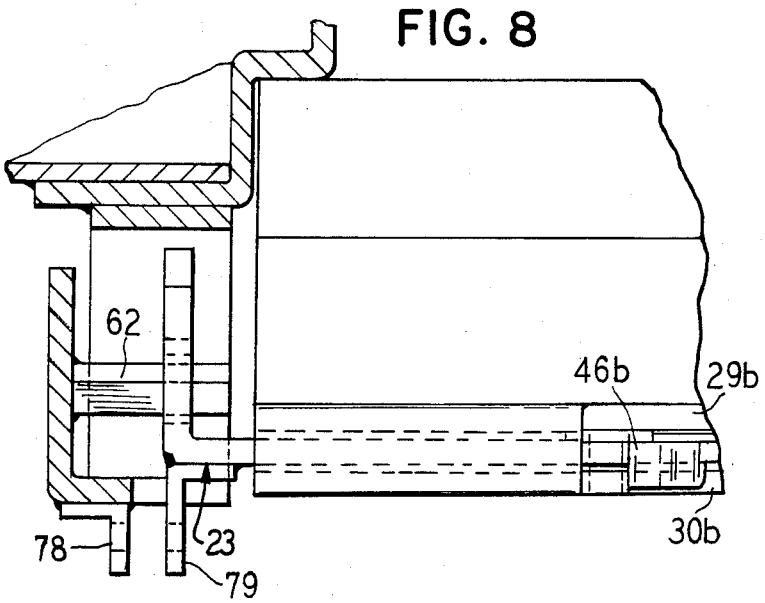

PILFERAGE DETERRENT DEVICE FOR LADING, CARRYING VEHICLES, SUCH AS BOXCARS AND THE LIKE

This application is a continuation-in-part of my application Ser. No. 298,592 filed Sept. 2, 1981 and now abandoned.

BACKGOUND OF THE INVENTION

The losses from railway freight cars such as box cars are a large factor in the cost of shipment by rail. These losses particularly occur when the cars are in the yard or on a siding awaiting transfer to an unloading station or to another destination, even though locks and seals are provided for the doors and the seals are not intentionally broken except when the car is standing along an unloading dock. The locks and seals are readily accessible from the ground, both with sliding doors and plug types of doors, both of which doors are in common use at the present day. Even though the locks for these doors are sturdy, their accessibility requires little ingenuity and energy, to release the locks, with the result that the freight yards must be continuously policed, and even then the loss due to pilferage is substantial.

SUMMARY ADVANTAGES AND OBJECTS OF THE INVENTION

The pilferage deterrent device for box cars is positioned so that it cannot be released from the ground even with a pole or other instrument and can only by released by hand by a man standing on a loading dock or other elevated platform and even then cannot be pried or otherwise moved to a release position except by an authorized person knowing how to release the lock.

The pilferage deterrent device drops to a locked position by gravity and supplements the usual door locks and may be in position on the door, where it is inaccessible except from an elevated position relative to the ground and is entirely enclosed except for a portion of the top sufficient to accommodate access to a pivoted trigger or cocking member for the lock which is manually moved to cam the lock, to a release position, and then accommodate opening of the door with no further attention except pressure on the door in a door opening direction.

An object of the present invention is to provide a simple and improved means for protecting lading carrying vehicles, such as boxcars and the like from pilferage.

A further object is to provide a simplified form of protective device for box car doors which cannot be released from the ground by the hand, while the car is standing in the yard or on a siding, and is only accessible for release from an elevated platform, such as a loading dock.

An advantage of the invention is that the pilferage deterrent device is adaptable to various types of box car doors and its moving parts are concealed so the lock cannot be released by a pole and the like, and can only be released from the top of the lock by a man on the an elevated platform loading dock and knowing the operation of the lock.

Another advantage of the invention is that the device is toward the top of the door of either the sliding or plug type and then is only accessible for release from an elevated platform and cannot be released from the bottom of the device or the sides or ends thereof.

Still another advantage is that the device is of a simplified form with a minimum number moving parts and does not interfere with locking of the lock, by gravity.

Other objects, features and advantages of the invention will be readily apparent from the following description of a preferred embodiment therof, taken in conjunction with the accompanying drawings, although variations and modifications may be effected without departing from the spirit and scope of the novel concepts of the following disclosure.

DESCRIPTION OF THE DRAWINGS

FIG. 5 is a horizontal sectional view of a modified form of latch and keeper arrangement adapted for trucks, trailers and freight cars, showing the latch, in latching engagement with its keeper, as the door is closed, with certain parts shown in horizontal section.

FIG. 6 is a view in side elevation illustrating still another modified form of pilferage deterrent device adapted for a plug type door for freight containers, which may be constructed in accordance with the principles of the present invention.

FIG. 7 is a fragmentary sectional view taken substantially along line VII—VII of FIG. 6; and FIG. 8 is fragmentary sectional view taken substantially along line VIII—VIII of FIG. 6.

Figure 1:
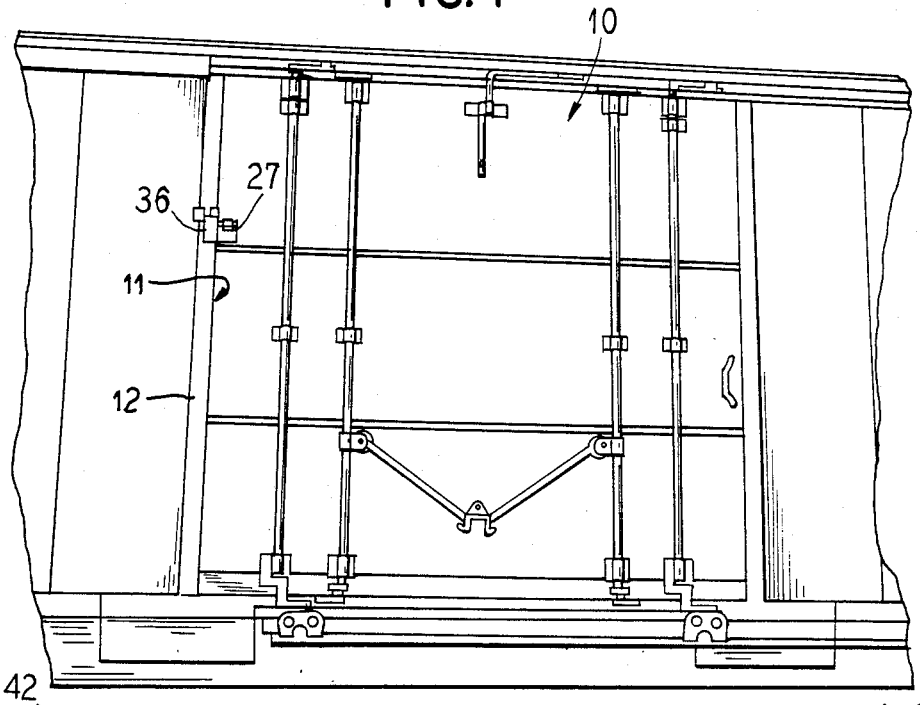
FIG. 1 is a fragmentary view of one side of a railway box car, diagrammatically showing a plug type door closing the doorway to the car and diagrammatically showing the pilferage deterrent device constructed in accordance with the principles of the present invention mounted on the door and a door post defining one margin of the doorway.

In the drawings, I have shown in FIG. 1 a fragmentary view of the side of a railroad boxcar of the type in which a conventional plug door 10 of the lever type closes a door opening 11.

The plug door 10 and mechanism for moving the door from an open to a closed position flush with the side of the car are well known to those skilled in the art so need not be shown or described herein, except to point out that the door is supported for movement from an open position in alignment with the door opening 11 and when moved inwardly along the door opening toward a closed position, when in alignment with the door opening the door is moved along the door opening to a position substantially flush with the side of the car along a Z-bar 12 (FIG. 4) forming a door post.

Figure 4:
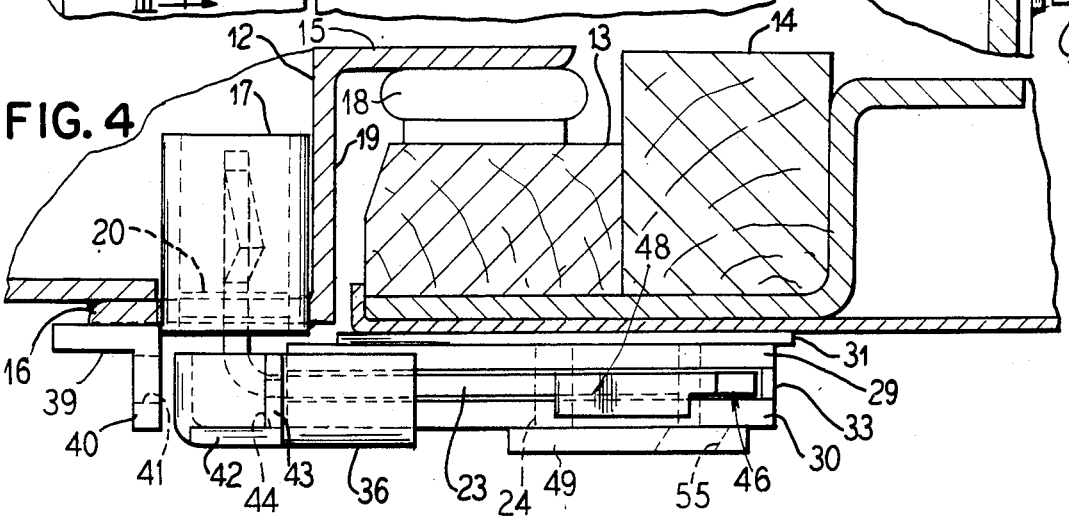
FIG. 4 is a plan view of the pilferage deterrent device taken along line IV—IV of FIG. 3.

The door is shown in FIG. 4 as a steel door having a recessed end portion for blocks 13 and 14. A door stop 18 mounted on the block 13, engages a leg 15 of the Z-bar extending parallel to the door, when the door is closed. A leg 16 of the Z-bar, parallel to the leg 15 and extending along car has an opening therein to receive a rectangular keeper sleeve 17 which may be welded or otherwise secured thereto to extend along an inwardly extending leg of the Z-bar.

Figure 3:
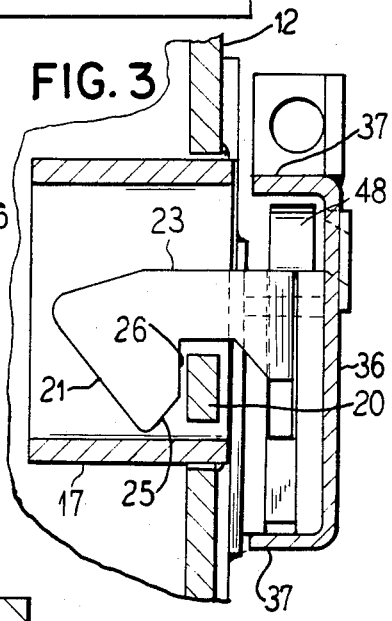
FIG. 3 is a sectional view of the pilferage deterrent device taken substantially along line III—III of FIG. 2.

The keeper sleeve 17 is best shown is FIGS. 3 and 4 and has a keeper bar 20 extending thereacross, adapted to engage an advance inclined strike surface 21 of an eccentrically pivoted latch 23, pivoted to the side of the door adjacent its rear end, on a transverse pivot pin 24 for free up and down movement, to accommodate an inclined surface 25 of the latch inclined downwardly from the strike surface 21, to ride along said keeper bar and allow the latch to freely drop by gravity as the door is moved toward a closed position, with a vertical latching surface 26 of the latch extending along the inside of the keeper bar 20 to retain the door from opening, except when the latch is cammed to a release position about the pivot pin 24, by operation of a trigger or release member 46, in a manner which will hereinafter be more clearly described as this specification proceeds.

It will be noted that the keeper bar 20 extends parallel to the plane of the door while the strike surface 21 of the latch and inclined camming surface 25 thereof as well as the vertical latching surface 26 extend parallel to the plane of the door, as clearly shown in FIGS. 3 and 4. The body of the latch itself also extends parallel to the plane of the door. The axis of the pivot 24 is perpendicular to the plane of the door and the latch is relatively loosely fitted on the pivot pin 24 to accommodate free movement of the latch to a latching position, as well as camming of the latch to an open position, as pressure is exerted on the inclined camming surface 25 of the latch and particularly when the release member or trigger 46 is operated to cam the latch into position to accommodate movement of the door to an open position upon door opening pressure on the latch.

The strike surface 21 is also inclined toward a wall of the sleeve 17, which may be at an angle from 5 to 10 degrees, to compensate for possible angularity between the strike portion of the latch and keeper 20 and to add to the effective work area of the strike surface 21, to assure free camming of the latch to open and closed positions, particulary where the door may be misaligned with respect to the sleeve 19 and keeper bar 20, and to thereby assure free operation of the latch, regardless of the condition of the car door.

The main body portion of the latch 23 is eccentrically pivoted on the pivot pin 22, and extends parallel to the plane of the door within a housing 27. Said housing 27 includes two parallel spaced plates 29 and 30, the inner plate of which may be welded or otherwise secured to a plate 31, which may be welded to the front surface of the door and extend close into position to the plane of an inner face 32 of the leg 19 of the Z-bar 12.

A spacer 33 spaces the plates 29 and 30 apart adjacent the rear ends thereof, and extends for a height of said plates to prevent access to the latch 23 and release member 46 from the rear end thereof.

Figure 2:
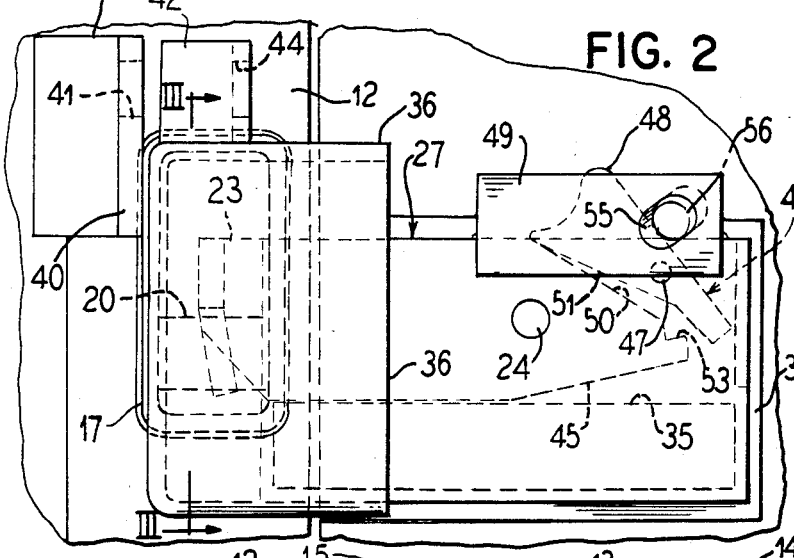
FIG. 2 is an enlarged view of the lock, showing the lock in a locked condition.

The end of the latch head including the strike surface, camming surface and the bottom surface thereof, are covered by a latch cover 36, spaced outwardly of latch proper but having inturned upper and lower ends 37, 37 the lower end of which may be welded or otherwise secured to the bottoms of the plates 29 and 30, to completely cover the end and under surface of the latch, in its latched position, and to prevent opening thereof from beneath the latch proper. The plates 29 and 30 are further spaced apart adjacent the lower ends thereof by a spacer bar 35 (FIG. 2). The latch 23 is therefore fully protected from beneath and along its rear and advance portions, to make it impossible to release the latch from its front or rear and to make it necessary to operate the release member or trigger 46 from above the latch, to move the latch in a release direction.

A seal bracket 39 extends upwardly along the outer leg of the Z-bar 12, and may be welded or otherwise secured thereto, and has an outwardly extending right angled leg 40 apertured as indicated by reference numeral 41, to accommodate a conventional seal (not shown) to pass therethrough. A similar seal bracket 42 extends upwardly of the cover 36 and has an inwardly extending right angled leg 43, apertured to accommodate sealing of the door in a closed position by a seal passing through the apertured portions of the seal brackets 39 and 42. The seals may be of any conventional form, commonly used to seal freight car doors so need not herein be shown or described further.

In order to accommodate release of the latch from above the latch a release member or trigger 46 is provided. Where dirt may lodge on the upper surface of the spacer bar 35, the portion of latch 23 beneath its pivot 24 may be inclined upwardly, of the spacer bar 35, to the rear end portion of the latch, as indicated by reference numeral 45.

The release member or trigger 46 is freely pivoted between the plates 29 and 30, on a pivot pin 47, spaced rearwardly of the pivot pin 24. A counterweight 48 similar to the counterweight of my patent application Ser. No. 298,592 extends outwardly along the plate 30, as shown in FIG. 2. Said counterweight is formed as a part of the upper end of the trigger or release member 46 and extends above a guard plate 49 for the trigger, and engages the upper surface of the plate 30 to bias the trigger 46 to a released position.

FIG. 2 shows the top portion of a trigger 46 sealed by the plate 49 with the counterweight 48 projecting a slight distance above said plate 49 to enable the trigger to be moved in a release direction by hand, herein shown as being a clockwise direction. The trigger 46 when stopped from movement in a counter-clockwise direction by the plate 30, is inclined along its under portion to extend away from a stepped rear end portion of latch 23, and is normally biased in this position by gravity, when the latch is in the latching position shown in FIG. 2.

The latch 23 has a rear inclined face 50, to provide clearance between the latch and trigger, when the latch is locked into engagement with the keeper bar 20, as in my parent application Ser. No. 298,592. The trigger has a companion inclined under face 51. The inclined face 50 of the latch terminates into a step 53 slightly rounded at the outer end of the tread of the step to be engaged by the lower end of said trigger 46 and cam the latch to a release position as the trigger 46 is moved about its pivot in a clockwise direction.

The latch 23 may thus be manually released from above the plate 49 by merely engaging the portion of the counterweight 48 for the trigger 46, projecting above the plate 49, and pushing the counterweight and trigger in a clockwise direction until the lower end of the trigger comes into engagement with the step 53 and raises the latch sufficiently to accommodate the keeper bar 20, to cam the latch about its pivot 24, upon outward movement of the door relative to the door post 12. It should here be understood that when the trigger 46 raises the latch to the position shown in FIG. 6 the trigger will hold the latch in this position until it is desired to open the door. After the trigger is set no further attention is required to open the door.

The plate 49 has an elongated slot 55 to receive a bolt or seal 56, to accommodate a seal cable or a shank of a bolt to extend through the slot 55. The seal may be a conventional bell type of slip-on-seal having a head (not shown) engaging the plate 49 in which a locking bell (not shown) is slipped on the outer end of a flexible cable extending from the head through the slot 55 and moved inwardly along the cable into the slot 55 to positively prevent movement of the trigger 46 in a direction to pivot the latch 23 to an open position.

In FIGS. 5, 6, 7, and 8 I have shown modified forms of pilferage deterrent devices for plug doors, similar to that shown in FIGS. 1 through 4. The principle of operation of these modified forms of pilferage deterrent device, is similar to that shown and described in FIGS. 1 through 4 so a detailed description thereof need not be necessary herein, except to point out the features different from the form of the invention shown in FIGS. 1–4.

In the form of the invention illustrated in FIG. 5, an oblong keeper sleeve 17*a* is welded or otherwise secured to a plate 59 bolted to the inside of the car as by nuts and bolts 60, the bolts of which extend through the back plate 58, abutting the inside of the car or container wall. The bolt holes may be elongated (not shown) either up or down or sideways, to accommodate adjustment of a sleeve 17*a*, and the keeper bar 20, extending thereacross, in the same manner the keeper bar 20 extends across the keeper sleeve 17. The securing plate 59 has a seal bracket 61, extending outwardly and upwardly therefrom, along a portion of the sleeve, projecting outwardly of the plate 59. Said seal bracket is apertured as indicated by reference numeral 63. The apertured portion of said seal bracket registers with an apertured portion (not shown) of a seal bracket 64 extending upwardly from a cover 66, extending along and beneath and above plates 29*a* and 30*a*, between which a latch 23 is mounted, and pivoted thereto toward its rear end on a pivot pin eccentric of its center, with a relatively loose fit, to accommodate the latch to freely drop to a latched position upon inward movement of the door, as in the form of the invention illustrated in FIGS. 1–4.

Plates 29*b* and 30*b* form a mounting and housing for the latch 23 and are spaced apart by a spacer bar extending along the bottom of the latch in the manner shown in the form of the invention illustrated in FIGS. 1–4. The plate 29*a* has a plate 67 abutting the inner side thereof and welded or otherwise secured thereto, and abutting a spacer 69, abutting the outer side of the door. The plate 67 and spacer 69 are secured to the door as by nuts and bolts 70, extending through the plate 67 and the car or container door and shown as having heads 71 recessed in a back-up plate 69 abutting the inside of the door and held thereto by the nuts and bolts 70. The thickness of the spacer 69 may be varied to properly position the latch relative to the keeper bar 20*a*, to assure free movement of the latch to a locked position in engagement with the keeper bar 21*a* by gravity, as the door is closed, and free opening of the latch by operation of a release member or trigger 46*a* like the trigger 46 and operates in the same mannner as said trigger 46.

A trigger guard (FIG. 5) is welded or otherwise secured to the plate 30*a* and extends upwardly thereform along the outer side of the trigger to a position close to the top of the counterweight 48*a* of said trigger.

In the embodiment of the invention shown in FIGS. 6, 7, and 8, the latch and keeper are enclosed in individual housings, for a greater portion of the length of said latch, and are inaccessible except by engagement of a release member or trigger 46*b* from the top of the housing. In this form of the invention, a latch lever 23*b* is eccentrically pivoted between plates 29*b* and 30*b* of a housing 27*b*, on a transverse pivot pin 24*b*, disposed adjacent the rear end of said latch lever. The latch lever has a right angled strike surface 21*b* extending perpendicular to the plane of the door to engage an inclined surface of a peaked keeper 62 extending in a direction parallel to the door post and door openin9 as the door is closed.

As the door is moved to a closed position, the strike surface 21*b* of the latch will come into engagement with the inclined surface 74 of the keeper. This will cam the latch over the keeper, to drop into the position shown by solid lines in FIG. 7, with a recessed portion of the latch extending along opposite sides of the keeper.

The release member or trigger 46*b* is pivoted between the side plates of the housing 76 on a pivot pin 47, to release the latch from above the latch housing 76 as in the forms of anti-pilferage devices illusrated in FIGS. 2, 3 and 4.

Seal tabs 78 and 79 having registering apertured portions for a conventional seal, are shown in FIGS. 6 and 8 as extending outwardly of the outer side of the latch and keeper housing.

It may be seen from the foregoing that the pilferage deterrent device of the present invention may readily be adapted to various types of box cars, container, and trailer doors and is enclosed to prevent opening of the latch by hand except by operation of the release member or trigger 46*b* which is at such an elevation and is spaced inwardly of its housing so it cannot ordinarily be reached by hand or by a bar or pole or other tool except from an elevated position.

While the latch and keeper structure may be of various forms, it should be understood that an important part of the invention, in addition to placing the pilferage deterrent device at an elevation inaccessible to pilferers are that the trigger is enclosed except for the upper portion of the counterweight making it difficult to release the trigger. The trigger deterrent device can thus only by operated to release the latch by engaging the counterweight of the trigger from above the latch casing and at an elevation that can only be reached from a loading dock or other elevated platform.

In the present disclosure, the pilferage deterrent device may be located at least seven feet above the floor or bottom of the box car door, and cooperates with the conventional locks disposed adjacent the bottom of the door and prevents opening of the door even though the bottom latches are in release positions. It should be understood, however, that the device may be at other elevations, where it is not accessible to the average individual.

I claim as my invention:

1. A pilferage deterrent device for a door assembly for a lading carrying vehicle having a floor and vertical side and end walls upwardly therefrom to form an enclosure and a door opening leading through at least one of said walls a door movable from an open position into a position in alignment with the door opening and into the door opening in a direction perpendicular to the plane of the side of the door, a keeper recessed in a side wall of the vehicle adjacent the door opening and extending parallel to the plane of the door, a latch extending along the door and parallel thereto beyond the door opening, a pivot for said latch eccetric of the center thereof, enabling said latch to drop to a latched position by gravity, said latch having a free end portion extending at right angles to the plane of the door and having an advance strike surface engageable with said keeper, a camming surface extending from said strike surface in a direction toward the outer side of the door when the latch is in its locked position and a latching surface engageable with said keeper to retain the door from outward movement relative to the door opening, a trigger pivoted for movement about an axis outside of the limits of said latch but within the extended margins thereof and parallel to the pivotal axis of the latch, said trigger serving as a hidden release for the latch and having a camming end depending from its pivot, a counterweight forming the upper end of said trigger and spaced along said latch from the pivotal axis of said trigger to a position above the pivotal axis of said latch and biasing the camming end of said trigger out of engagement with said latch, said latch having a portion at its rear end adapted to be engaaged by the camming end of said trigger, upon movement of said trigger about its axis toward the rear end portion of said latch, to raise said latch relative to said keeper and to release said latch from said keeper upon movement of the door in a direction to open the door, and a casing for said latch and trigger mounted on the door at an elevation closer to the top than the bottom of the door whereby the trigger cannot normally be reached except from an elevated platform, and preventing access to said counterweight except from the top thereof, said casing for said latch including parallel spaced plates, an inner plate of which is secured to the door, at least one spacer bar spacing said plates apart and preventing access to said latch from beneath the body of said latch, and a guard plate extending from the outermost of said plates upwardly along the outside of said trigger close to the upper end thereof.

2. The pilferage deterrent device of claim 1 in which the counterweight extends along the outermost of said plates inside of said guard plate and has an under surface extending over and along the top surface of the outermost of said plates to limit movement of said trigger in a direction toward said latch and keeper.

3. The pilferage deterrent device of claim 2 including a door post defining a margin of the door opening, a sleeve recessed in the door post in alignment with and opening to the strike surface of said latch, and in which said keeper is a bar enclosed by and extending across said sleeve and secured thereto at its ends.

4. The pilferage deterrent device of claim 3 in which the strike surface of said latch extends at right angles relative to the plane of the door to enter said sleeve when the door is pushed inwardly into a closed position.

5. The pilferage deterrent device of claim 3 in which the door post is in the form of a Z-bar having oppositely extending legs and the sleeve extends through and is mounted on the outermost of said legs.

6. The pilferage deterrent device of claim 2 including a sleeve recessed within the car wall adjacent the door opening, a mounting plate secured to the outer surface of the car wall and mounted on the car wall adjacent the door opening, a backing plate secured to the inside of the car wall, and securing means extending through said backing plate and mounting plate, and mounting said mounting plate and sleeve to the wall of the car adjacent the door opening.

7. The pilferage deterrent device of claim 6 in which the mounting plate and back-up plate are adjustably mounted on the wall of the car, to align said sleeve and keeper with the strike and inclined surface of the latch.

8. The pilferage deterrent device of claim 6 in which the strike surface of the latch and inclined camming surface thereof extend at right angles with respect to the body of the latch in a direction parallel to the axis of said pivot and said surfaces are inclined toward the door opening at an angle in the order of 10°.

* * * * *